US010330042B2

(12) United States Patent
Lee et al.

(10) Patent No.: US 10,330,042 B2
(45) Date of Patent: Jun. 25, 2019

(54) WATER JACKET FOR CYLINDER HEAD

(71) Applicants: HYUNDAI MOTOR COMPANY, Seoul (KR); KIA MOTORS CORPORATION, Seoul (KR)

(72) Inventors: Byung Soo Lee, Seoul (KR); Bong Sang Lee, Seongnam-si (KR)

(73) Assignees: HYUNDAI MOTOR COMPANY, Seoul (KR); KIA MOTORS CORPORATION, Seoul (KR)

( * ) Notice: Subject to any disclaimer, the term of this patent is extended or adjusted under 35 U.S.C. 154(b) by 0 days.

(21) Appl. No.: 15/788,312

(22) Filed: Oct. 19, 2017

(65) Prior Publication Data

US 2018/0340489 A1 Nov. 29, 2018

(30) Foreign Application Priority Data

May 29, 2017 (KR) ..... 10-2017-0066143

(51) Int. Cl.

| | |
|---|---|
| ***F02F 1/40*** | (2006.01) |
| ***F01P 3/02*** | (2006.01) |
| *F02B 75/20* | (2006.01) |
| *F02B 75/18* | (2006.01) |

(52) U.S. Cl.

CPC ..... *F02F 1/40* (2013.01); *F01P 3/02* (2013.01); *F01P 2003/024* (2013.01); *F02B 75/20* (2013.01); *F02B 2075/1816* (2013.01)

(58) Field of Classification Search

CPC ..... F02F 1/40; F01P 3/02; F01P 2003/024; F01P 3/14; F02B 75/20

See application file for complete search history.

(56) References Cited

U.S. PATENT DOCUMENTS

| | | | | |
|---|---|---|---|---|
| 2009/0126659 | A1 | 5/2009 | Lester et al. | |
| 2016/0258381 | A1 * | 9/2016 | Tempesta | F02F 1/14 |

FOREIGN PATENT DOCUMENTS

| | | | |
|---|---|---|---|
| DE | 19943003 | C1 | 11/2000 |
| DE | 10026376 | A1 | 11/2001 |
| DE | 10048582 | A1 | 4/2002 |
| EP | 1628012 | A2 | 2/2006 |
| GB | 2175046 | A | 11/1986 |
| JP | 2011-094523 | A | 5/2011 |

OTHER PUBLICATIONS

Extended European Search Report issued in Application No. 17196759.9 dated Mar. 28, 2018.

* cited by examiner

*Primary Examiner* — Jacob M Amick

(74) *Attorney, Agent, or Firm* — Morgan Lewis & Bockius LLP

(57) ABSTRACT

A water jacket for a cylinder head includes: an upper body disposed at an upper part of the cylinder head inside the cylinder head and through which a coolant flows; a lower body disposed under the upper body inside the cylinder head and through which the coolant flows; and a connector disposed corresponding to a position of an exhaust valve between the upper body and the lower body and integrally connected to the upper body and the lower body. Tt least one penetration hole is formed in the connector along a length direction.

8 Claims, 3 Drawing Sheets

WATER JACKET FOR CYLINDER HEAD

CROSS-REFERENCE TO RELATED APPLICATION

This application claims the benefit of priority to Korean Patent Application No. 10-2017-0066143 filed in the Korean Intellectual Property Office on May 29, 2017, the entire content of which is incorporated herein by reference.

TECHNICAL FIELD

The present disclosure relates to a water jacket for a cylinder head. More particularly, the present disclosure relates to a water jacket for a cylinder head that may improve overall cooling efficiency by controlling coolant flow.

BACKGROUND

Generally, some of heat generated at a combustion chamber of an engine is absorbed by a cylinder head, a cylinder block, intake and exhaust valves, a piston, etc.

When temperatures of the constituent components of the engine excessively increase, the constituent components may be thermally deformed, or an oil film of an inner wall of a cylinder may be degraded such that lubrication performance deteriorates, resulting in thermal problems of the engine.

Due to the thermal problems of the engine, abnormal combustion such as combustion failure, knocking, etc. occur, thus a piston may be melted, which may result in serious damage to the engine. Further, thermal efficiency and power of the engine may deteriorate. In contrast, excessive cooling of the engine may cause the power and fuel consumption to deteriorate, and may cause low temperature abrasion of the cylinder, thus it is necessary to appropriately control temperature of the coolant.

In this respect, in a typical engine, a water jacket is provided inside a cylinder block and a cylinder head, and a coolant circulating in the water jacket cools a periphery of a spark plug corresponding to a combustion chamber and metal surfaces such as peripheries of an exhaust port, a valve seat, etc.

However, in the typical engine, since the coolant flowing in according with the order of cylinders is sequentially circulated in the water jacket provided in the cylinder block, portions of the cylinder block corresponding to upper and lower portions of the combustion chamber at which a relative temperature difference is generated are not effectively cooled, such that the cooling of the engine is not entirely sufficient.

In addition, durability of the engine deteriorates due to poor cooling efficiency of the engine, and if a separate cooling jet is provided and a high performance water pump is used in order to prevent the deterioration of the durability of the engine, costs thereof may increase.

Further, when the temperature of the coolant is low, viscosity of engine oil is high, thus as frictional force increases, fuel consumption increases, that is, fuel efficiency deteriorates, while when the coolant temperature is excessively high, since knocking occurs, performance of the engine may deteriorate by adjusting ignition timing in order to suppress the knocking.

The above information disclosed in this Background section is only for enhancement of understanding of the background of the invention and therefore it may contain information that does not form the prior art that is already known in this country to a person of ordinary skill in the art.

SUMMARY

The present disclosure relates to a water jacket for a cylinder head maximizing a cooling effect by cooling a coolant flowing from a cylinder block into a cylinder head as a cross-flow type to flow from an exhaust valve side to an intake valve side.

A water jacket for a cylinder head according to an exemplary embodiment of the present disclosure includes: an upper body disposed at an upper part of the cylinder head inside the cylinder head and through which a coolant flows; a lower body disposed under the upper body inside the cylinder head and through which the coolant flows; and a connector disposed corresponding to a position of an exhaust valve between the upper body and the lower body and integrally connected to the upper body and the lower body, wherein at least one penetration hole is formed in the connector along a length direction.

The penetration hole may be respectively formed between each combustion chamber of an engine and at both ends in the length direction of the connector to prevent the coolant inflowing from the lower body from directly inflowing to the upper body.

When the coolant inflows from the lower body to the upper body, a flow speed may increase through the connector partition by the penetration hole.

The lower body may include: a plurality of inflow protrusions formed for each combustion chamber along the length direction at a lower surface corresponding to the position of the connector; and a plurality of exhaust protrusions formed for each combustion chamber along the length direction at the position facing the inflow protrusion by corresponding to the position of the intake valve.

The connector may inflow the part of the coolant inflowing through each inflow protrusion inside the cylinder block to the upper body.

Each exhaust protrusion may exhaust the coolant passing through the lower body to the cylinder block except for the coolant inflowing to the upper body through the connector.

The coolant inflowing to each inflow protrusion may flow as a cross-flow type so as to pass through an intake valve side from an exhaust valve side of the cylinder head while moving along the length direction of the cylinder head and being exhausted to each exhaust protrusion.

The coolant inflowing to the cylinder block through each exhaust protrusion may be exhausted outside from the cylinder block through a separate exhaust core disposed at one side separated from the lower body.

A coolant exhaust port may be formed in the upper body.

As above-described, according to the water jacket for the cylinder head according to an exemplary embodiment of the present disclosure, as the coolant inflowing from the cylinder block to the cylinder head cools the engine as the cross-flow type so as to flow from the exhaust valve side to the intake valve side, the cooling effect of the engine may be maximized.

Also, by forming the penetration hole so as to position the partition dividing the water jacket for the cylinder head into the upper and lower body and preventing the flow of the coolant between each combustion chamber, as the flow speed of the coolant inflowed from the lower body to the upper body increases, the cooling efficiency may be improved through overheating prevention of the exhaust valve side having a relatively high temperature in the cylinder head.

Also, a crack of and damage to the cylinder head may be prevented, and durability of the cylinder head may be improved.

DETAILED DESCRIPTION OF THE EMBODIMENTS

Figure 1:
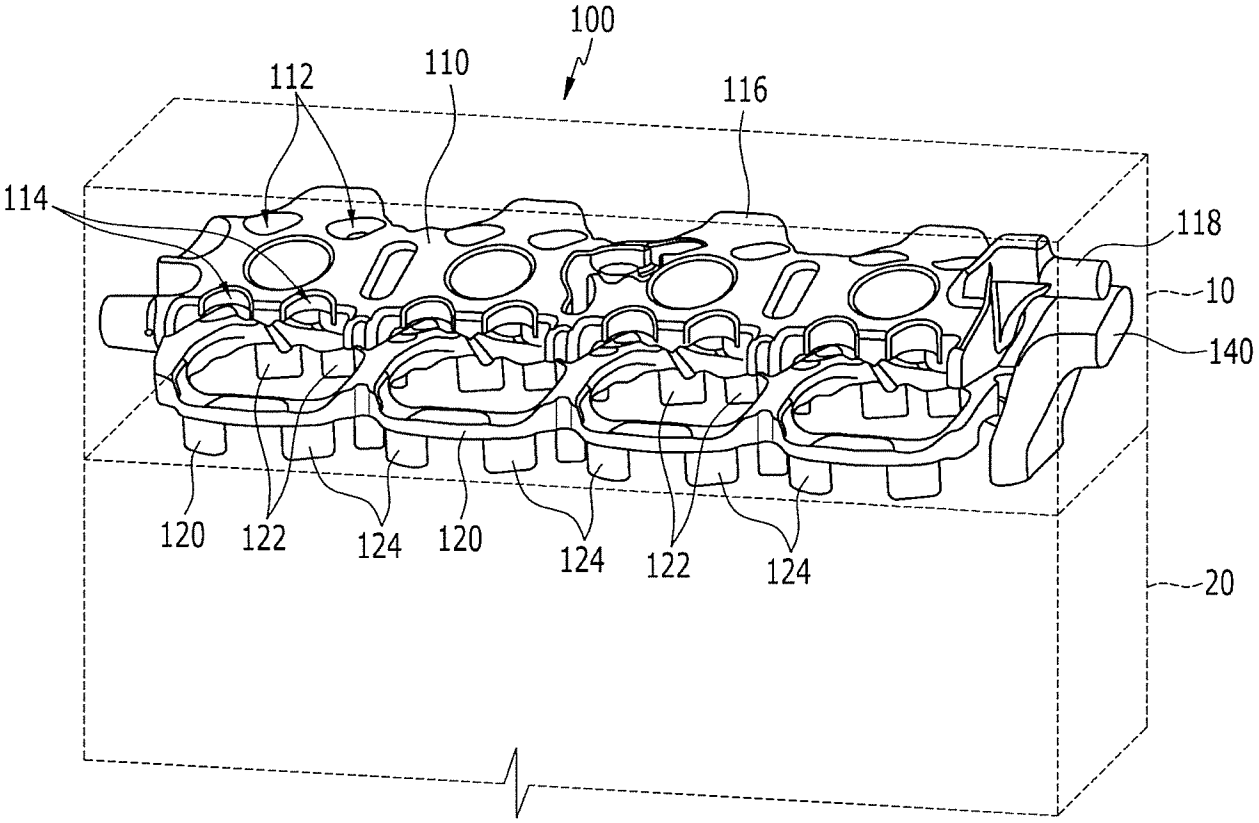
FIG. 1 is a perspective view of a water jacket for a cylinder head according to an exemplary embodiment of the present disclosure.

An exemplary embodiment of the present disclosure will hereinafter be described in detail with reference to the accompanying drawings.

The embodiment described in the present specification and the configuration shown in the drawings are merely an exemplary embodiment of the present disclosure and do not represent all of the technical spirit of the present disclosure. Thus, it should be understood that there may be various equivalents and modified examples that can replace the embodiments described in the present specification and the configuration shown in the drawings at the time of filing the present application.

In order to clearly describe the present disclosure, parts that are irrelevant to the description are omitted, and identical or similar constituent elements throughout the specification are denoted by the same reference numerals.

Since the size and thickness of each configuration shown in the drawings are arbitrarily shown for convenience of description, the present disclosure is not necessarily limited to configurations illustrated in the drawings, and in order to clearly illustrate several parts and areas, enlarged thicknesses are shown.

Moreover, throughout the specification, unless explicitly described to the contrary, the word "comprise" and variations such as "comprises" or "comprising" will be understood to imply the inclusion of stated elements but not the exclusion of any other elements.

Furthermore, terms such as " . . . unit", " . . . means", " . . . part", and " . . . member" described in the specification mean a unit of a comprehensive configuration having at least one function or operation.

Figure 2:
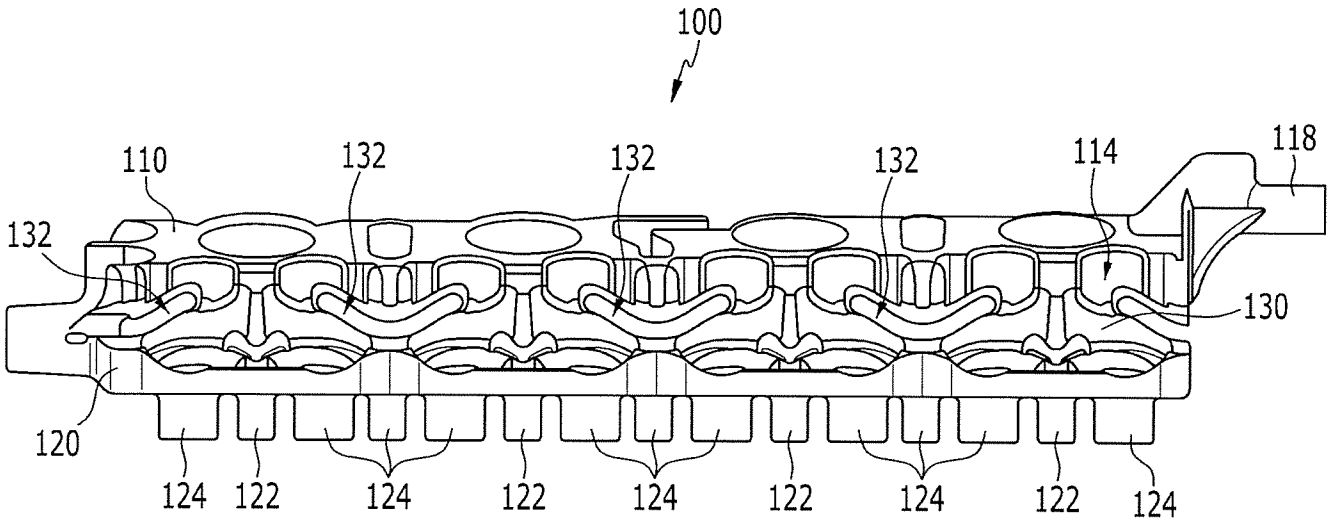
FIG. 2 is a front view of a water jacket for a cylinder head according to an exemplary embodiment of the present disclosure.
Figure 3:
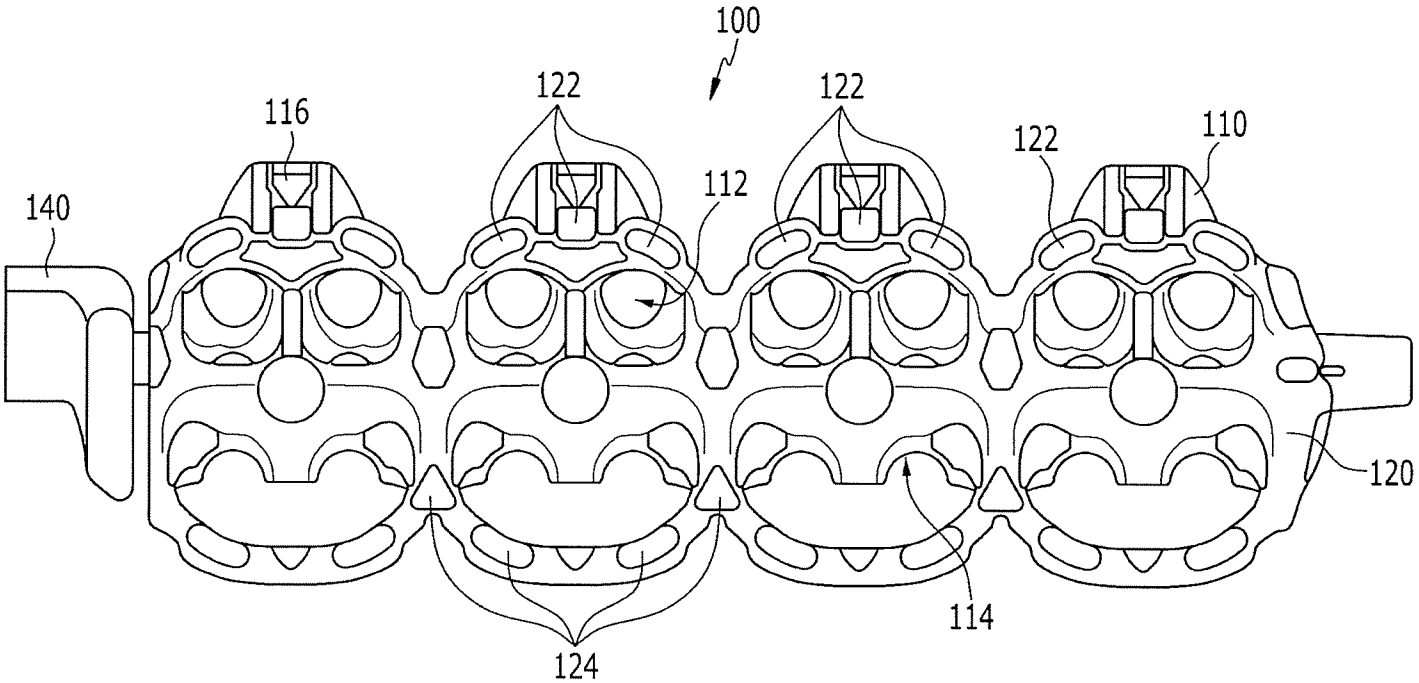
FIG. 3 is a rear view of a water jacket for a cylinder head according to an exemplary embodiment of the present disclosure.

FIG. 1 is a perspective view of a water jacket for a cylinder head according to an exemplary embodiment of the present disclosure, FIG. 2 is a front view of a water jacket for a cylinder head according to an exemplary embodiment of the present disclosure, and FIG. 3 is a rear view of a water jacket for a cylinder head according to an exemplary embodiment of the present disclosure.

Referring to FIG. 1, a water jacket 100 for a cylinder head according to an exemplary embodiment of the present disclosure is configured inside a cylinder head 10 in an engine configured of the cylinder head 10 and a cylinder block 20.

The water jacket 100 for the cylinder head, as shown in FIG. 1 and FIG. 2, includes an upper body 110, a lower body 120, and a connector 130.

Firstly, the upper body 110 is provided at an upper inside of the cylinder head 10, and a coolant flows therein.

The upper body 110 is provided with eight exhaust valve holes 112 and eight intake valve holes 114 that are formed along a length direction, respectively, and the exhaust valve holes 112 and the intake valve holes 114 are formed at positions corresponding to each combustion chamber.

In the present exemplary embodiment, eight exhaust and intake valves hole 112 and 114 are formed at the positions corresponding to each combustion chamber in a four-cylinder engine having four combustion chambers, however it is not limited thereto, and the positions and the number of exhaust and intake valve holes 112 and 114 may be changed and applied depending on the number and positions of the combustion chambers.

Here, the upper body 110 may be provided with a protrusion unit 116 protruded outward from the exhaust valve hole 112 so as to increase a flow rate of a coolant into the exhaust valve hole 112 side in which an exhaust gas of a high temperature is exhausted from the cylinder head 10.

Accordingly, the upper body 110 increases the flow rate of the coolant into the exhaust side of the cylinder head 10 through the protrusion unit 116, thereby efficiently cooling the cylinder head 10.

On the other hand, a coolant exhaust port 118 is formed on the upper body 110.

The coolant exhaust port 118 may exhaust the coolant cooling the upper part of the cylinder head 10 while passing through the upper body 110 outside the cylinder head 10.

In the present exemplary embodiment, the lower body 120 is disposed under the upper body 110 inside the cylinder head 10. The coolant inflowed from the cylinder block 20 flows in the lower body 120.

The connector 130 is disposed corresponding to the position of the exhaust valve between the upper body 110 and the lower body 120. The connector 130 integrally connects the upper body 110 and the lower body 120.

Here, at least one penetration hole 132 may be formed along the length direction in the connector 130.

As shown in FIG. 2, the penetration hole 132 may be respectively formed between the combustion chambers of the engine and both ends of the connector 130 in the length direction to prevent the coolant inflowing from the lower body 120 from directly inflowing into the upper body 120.

Accordingly, when the coolant inflows from the lower body 120 to the upper body 110, a flow speed may increase through the connector 130 partitioned by the penetration holes 132.

That is, as the penetration holes 132 prevent the flow of the coolant from flowing into unnecessary parts and simultaneously increases the flow speed of the coolant inflowing to the upper body 120 from the lower body 110, the coolant may quickly inflow into the upper body.

Accordingly, the coolant may quickly inflow into the exhaust valve side having a relatively high temperature on the cylinder head 10 and may efficiently cool the exhaust valve side of the cylinder head 10.

Meanwhile, in the present exemplary embodiment, the lower body 120, as shown in FIG. 3, further includes a plurality of inflow protrusions 122 and a plurality of exhaust protrusions 124.

First, the inflow protrusions 122 are formed for each combustion chamber at the lower surface corresponding to the position of the connector 130 along the length direction.

The exhaust protrusions 124 are formed for each combustion chamber along the length direction at the position facing the inflow protrusion 122 by corresponding to the position of the intake valve.

Therefore, the coolant inflowing to each inflow protrusion 122 and moving along the length direction of the cylinder head 10 may flow as the cross-flow type to pass through the intake valve side from the exhaust valve side of the cylinder head 10 while being exhausted to each exhaust protrusion 124.

The coolant flow of the cross-flow type may efficiently cool the cylinder head 20 having a relatively higher temperature than the cylinder block 20 because of the exhaust of the exhaust gas.

Here, the connector 130 may flow part of the coolant inflowing through each inflow protrusion 122 inside the cylinder block 20 to the upper body 110.

Accordingly, each exhaust protrusion 124 exhausts the coolant passing through the lower body 120 into the cylinder block 20 except for the coolant inflowed to the upper body 110 through the connector 130.

The coolant inflowed to the cylinder block through each exhaust protrusion 124 may be exhausted outside from the cylinder block 20 through a separate exhaust core 140 disposed at one side separated from the lower body 120.

That is, the water jacket 100 for the cylinder head according to an exemplary embodiment of the present disclosure cools the exhaust valve side having the relatively high temperature on the cylinder head 10 by using the coolant quickly inflowed to the upper body 110 from the lower body 120 through the connector 130.

In this case, the protrusion units 116 of the upper body 110 increases the flow rate of the coolant in the exhaust valve side of the cylinder head 10, thereby efficiently cooling the cylinder head 10.

Further, the lower body 120 inflows the coolant from the cylinder block 20 to the exhaust valve side through the inflow protrusions 122 and cools the cylinder head 20 by using the coolant flowing as the cross-flow type while being flowed in the length direction of the lower body 120 and being again exhausted to the cylinder block 20 through the exhaust protrusions 124 formed at the intake valve side.

Accordingly, the lower body 120 cools the lower part of the cylinder head 20 as the cross-flow type, thereby more efficiently cooling the engine.

Thus, when applying the above-configured water jacket 100 for the cylinder head 20 according to the exemplary embodiment of the present disclosure, as the coolant inflowed from the cylinder block 20 to the cylinder head 10 cools the engine as the cross-flow type to flow the coolant from the exhaust valve side to the intake valve side, the cooling effect of the engine is maximized.

Further, by forming the penetration hole 132 in the connector 130 connecting the upper and lower bodies 110 and 120 so as to position the partition dividing the water jacket for the cylinder head 100 into the upper and lower bodies 110 and 120 and preventing the flow of the coolant between each combustion chamber, as the flow speed of the coolant inflowed from the lower body 120 to the upper body 110 increases, the cooling efficiency may be improved through overheating prevention of the exhaust valve side having the relatively high temperature in the cylinder head 10.

A crack of and damage to the cylinder head 10 may be prevented through the efficient cooling, so the durability of the cylinder head 10 and the engine may be improved.

While this invention has been described in connection with what is presently considered to be practical exemplary embodiments, it is to be understood that the invention is not limited to the disclosed embodiments, but on the contrary, is intended to cover various modifications and equivalent arrangements included within the spirit and scope of the appended claims.

What is claimed is:

1. A water jacket for a cylinder head, comprising:

an upper body disposed at an upper part of the cylinder head inside the cylinder head, a coolant flowing through the upper body;

a lower body disposed under the upper body inside the cylinder head, the coolant flowing through the lower body; and a connector disposed corresponding to a position of an exhaust valve between the upper body and the lower body and integrally connected to the upper body and the lower body, wherein the connector has at least one penetration hole along a length direction, wherein the lower body includes:

a plurality of inflow protrusions for each combustion chamber along the length direction at a lower surface corresponding to a position of the connector; and a plurality of exhaust protrusions for each combustion chamber along the length direction at a position facing the plurality of inflow protrusions by corresponding to a position of an intake valve.

2. The water jacket for the cylinder head of claim 1, wherein the at least one penetration hole is respectively located between each combustion chamber of an engine and at both ends in the length direction of the connector to prevent the coolant inflowing from the lower body from directly inflowing to the upper body.

3. The water jacket for the cylinder head of claim 1, wherein when the coolant inflows from the lower body to the upper body, a flow speed increases through the connector partitioned by the at least one penetration hole.

4. The water jacket for the cylinder head of claim 1, wherein the connector inflows part of the coolant flowing through each inflow protrusion inside the cylinder block to the upper body.

5. The water jacket for the cylinder head of claim 4, wherein each exhaust protrusion exhausts the coolant passing through the lower body to the cylinder block except for the coolant inflowing to the upper body through the connector.

6. The water jacket for the cylinder head of claim 1, wherein the coolant inflowing to each inflow protrusion flows as a cross-flow type to pass through an intake valve side from an exhaust valve side of the cylinder head while moving along the length direction of the cylinder head and being exhausted to each exhaust protrusion.

7. The water jacket for the cylinder head of claim 1, wherein the coolant inflowing to the cylinder block through each exhaust protrusion is exhausted outside from the cylinder block through a separate exhaust core disposed at one side separated from the lower body.

8. The water jacket for the cylinder head of claim 1, wherein a coolant exhaust port is disposed in the upper body.

* * * * *